US008893943B2

(12) United States Patent
Wywialowski et al.

(10) Patent No.: US 8,893,943 B2
(45) Date of Patent: Nov. 25, 2014

(54) COLLATIONS FOR FASTENERS OF VARIOUS LENGTHS

(75) Inventors: Bruce Wywialowski, Elmhurst, IL (US); Richard Urban, Prospect Heights, IL (US)

(73) Assignee: Illinois Tool Works Inc., Glenview, IL (US)

( * ) Notice: Subject to any disclaimer, the term of this patent is extended or adjusted under 35 U.S.C. 154(b) by 846 days.

(21) Appl. No.: 12/761,602

(22) Filed: Apr. 16, 2010

(65) Prior Publication Data

US 2010/0200634 A1 Aug. 12, 2010

Related U.S. Application Data

(63) Continuation of application No. 10/838,614, filed on May 4, 2004, now Pat. No. 7,703,649.

(51) Int. Cl.
*B25C 1/16* (2006.01)
*B25B 23/04* (2006.01)

(52) U.S. Cl.
CPC ..... *B25B 23/045* (2013.01)
USPC ..... 227/120; 227/136

(58) Field of Classification Search
USPC ..... 227/120, 136, 147; 206/338, 820; 411/443
See application file for complete search history.

(56) References Cited

U.S. PATENT DOCUMENTS

| | | | | |
|---|---|---|---|---|
| 4,106,618 | A * | 8/1978 | Haytayan | 206/343 |
| 6,109,144 | A | 8/2000 | Muro | |
| 6,679,415 | B1 * | 1/2004 | Gupta | 227/120 |
| 6,814,231 | B2 * | 11/2004 | Gupta | 206/347 |
| 7,108,130 | B2 | 9/2006 | Herelier et al. | |
| 2005/0247749 | A1 * | 11/2005 | Wywialowski et al. | 227/120 |

FOREIGN PATENT DOCUMENTS

| | | |
|---|---|---|
| EP | 0479382 | 4/1992 |
| EP | 1391616 | 2/2004 |

* cited by examiner

*Primary Examiner* — Andrew M Tecco
*Assistant Examiner* — Nathaniel Chukwurah
(74) *Attorney, Agent, or Firm* — Maurice E. Finnegan, III; Beem Patent Law Firm

(57) ABSTRACT

A collation comprises a plurality of sleeves for supporting and carrying a plurality of fasteners through a magazine, wherein each of the plurality of sleeves have a front and a predetermined length of between about ¼ and about 0.4 inch, each of the plurality of fasteners have a predetermined length of between about ¾ inch and about 1 ½ inch and a tip located at a predetermined position from about 0.05 inch behind the sleeve front to about ¼ inch beyond the sleeve front, frangible bridges integrally connecting the plurality of sleeves together in a serial array and facilitating the separation of a leading one of the plurality of sleeves from remaining ones of the plurality of serially arranged sleeves when a drive member of the fastener driving tool drives a leading one of the fasteners disposed within the leading one of the sleeves, and a plurality of protrusions from the sleeves for engaging the rails in the magazine.

20 Claims, 7 Drawing Sheets

COLLATIONS FOR FASTENERS OF VARIOUS LENGTHS

This application is a continuation of U.S. patent application Ser. No. 10/838,614, filed May 4, 2004 (issuing as U.S. Pat. No. 7,703,649 on Apr. 24, 2010).

BACKGROUND OF THE INVENTION

1. Field of the Invention

The present invention is directed to collations for delivering fasteners to a fastener driving tool, particular to collations for holding fasteners of various lengths.

2. Description of the Related Art

Different construction applications may require different fastener lengths. Prior collations typically hold the fasteners proximate their heads regardless of overall fastener length, so that long fasteners typically have a long shank portion below the collation and short fasteners typically have a short shank portion below the collation. Tools for driving fasteners typically have an opening into the drive bore long enough for long shank portions so that a user may use the same tool for both the short fasteners and the long fasteners. However, a long drive bore opening provides an exit that allows short shank portions of short fasteners to tip or angle into the opening as short fasteners are driven, also known as "diving back" or "tumbling" into the magazine. Diving back may cause inaccurate driving of the fastener, jamming of the tool, or damage to the tool due to the large forces needed to drive the fasteners into the substrate. These problems are exacerbated when combustion-powered tools are used to drive fasteners into concrete or steel.

What is needed are collations that accommodate fasteners of various lengths while overcoming the problems of the prior art.

BRIEF SUMMARY OF THE INVENTION

A collation for transporting a plurality of fasteners along rails disposed within a magazine of a fastener driving tool is provided having a plurality of sleeves for supporting and carrying the plurality of fasteners through the magazine, each of the plurality of sleeves having a front and a predetermined length of between about ¼ and about 0.4 inch, each of the plurality of fasteners having a predetermined fastener length of between about ¾ inch and about 1 ½ inch and a tip located at a predetermined position from about 0.05 inch behind front of sleeve to about ½ inch beyond the front of sleeve. A plurality of frangible bridges integrally connect the sleeves together in a serial array and facilitate the separation of a leading one of the plurality of sleeves from remaining ones of the plurality of serially arranged sleeves when a drive member of the fastener driving tool drives a leading one of the plurality of fasteners disposed within the leading one of the plurality of sleeves. Each sleeve includes a plurality of protrusions for engaging rails in the magazine.

A system of collations for supplying fasteners of at least two different lengths to a fastener driving tool is provided. A plurality of first collations each have a plurality of sleeves each having a front, wherein the sleeves hold first fasteners having a tip located at a predetermined position relative to said sleeve front, and a plurality of second collations each have a plurality of second sleeves each having a front, wherein the second sleeves hold second fasteners having a tip located at the same predetermined position relative to the front of second sleeve, wherein the second fasteners are of a different length than the first fasteners.

These and other features and advantages are evident from the following description of the present invention, with reference to the accompanying drawings.

DETAILED DESCRIPTION OF THE INVENTION

Figure 1:
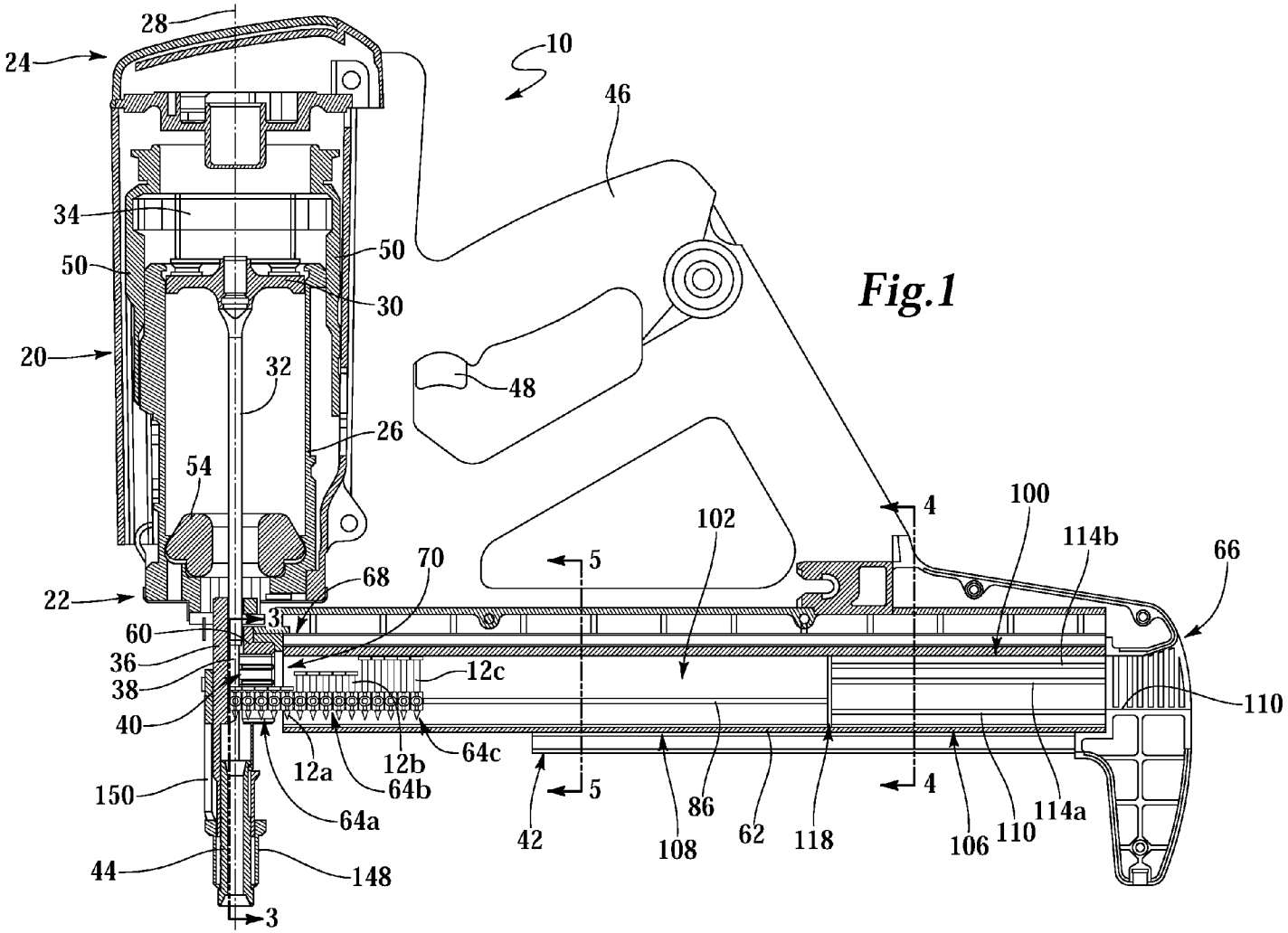
FIG. 1 is a partial side sectional view of a fastener driving tool with a nosepiece in an extended position.
Figure 2:
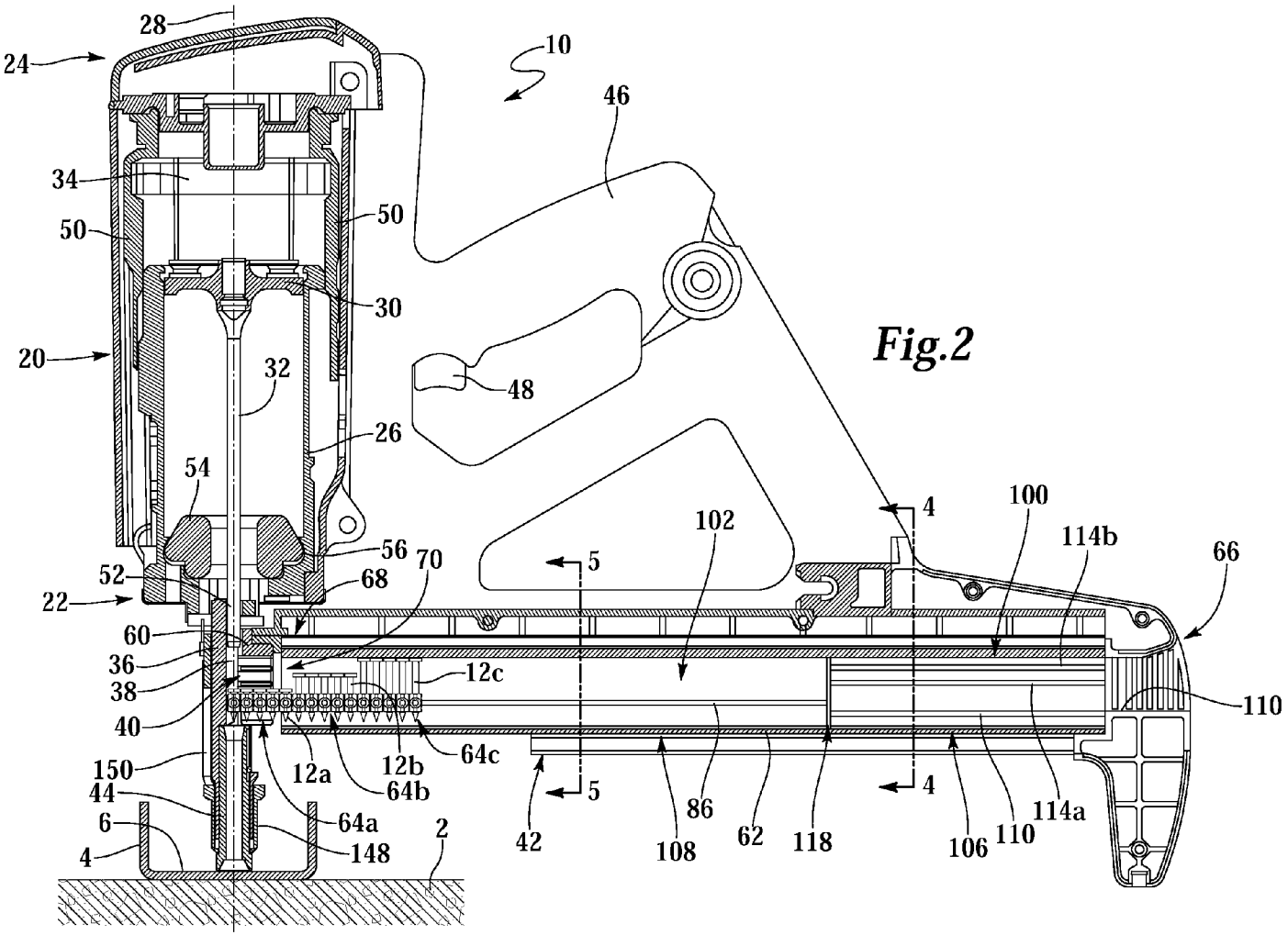
FIG. 2 is a partial side sectional view of the fastener driving tool with the nosepiece in a retracted position, wherein the nosepiece is pushed against a work surface.

Referring to FIGS. 1 and 2, a fastener driving tool 10 is shown having a guidance system that accommodates fasteners 12*a*, 12*b*, 12*c* of various lengths FL in collations 64*a*, 64*b*, 64*c* (see FIGS. 8A-8C) for driving fasteners 12*a*, 12*b*, 12*c* into a substrate 2. Tool 10 includes a tool body 20 having a front end 22, a rear end 24, and a cylinder 26 with an axis 28, a piston 30 mounted within cylinder 26, a power source, such as a combustion chamber 34 for combusting fuel, for driving piston 30 axially forwardly, a driver blade 32 extending axially forwardly from piston 30, a nosepiece 36 extending axially forwardly from front end 22 of tool body 20, wherein nosepiece 36 encloses a drive bore 38 for guiding fasteners 12*a*, 12*b*, 12*c* and driver blade 32 toward work surface 6, there being a loading opening 40 into drive bore 38 for fasteners 12*a*, 12*b*, 12*c*, and a magazine 42 for guiding fasteners 12*a*, 12*b*, 12*c* to loading opening 40. In one aspect of the invention, magazine 42 and nosepiece 36 are fixed with respect to each other, and tool 10 further includes a fastener guide 44 extending axially forwardly from nosepiece 36, wherein fastener guide 44 is movable with respect to nosepiece 36 between an extended position (FIG. 1) and a retracted position (FIG. 2).

Figure 3:
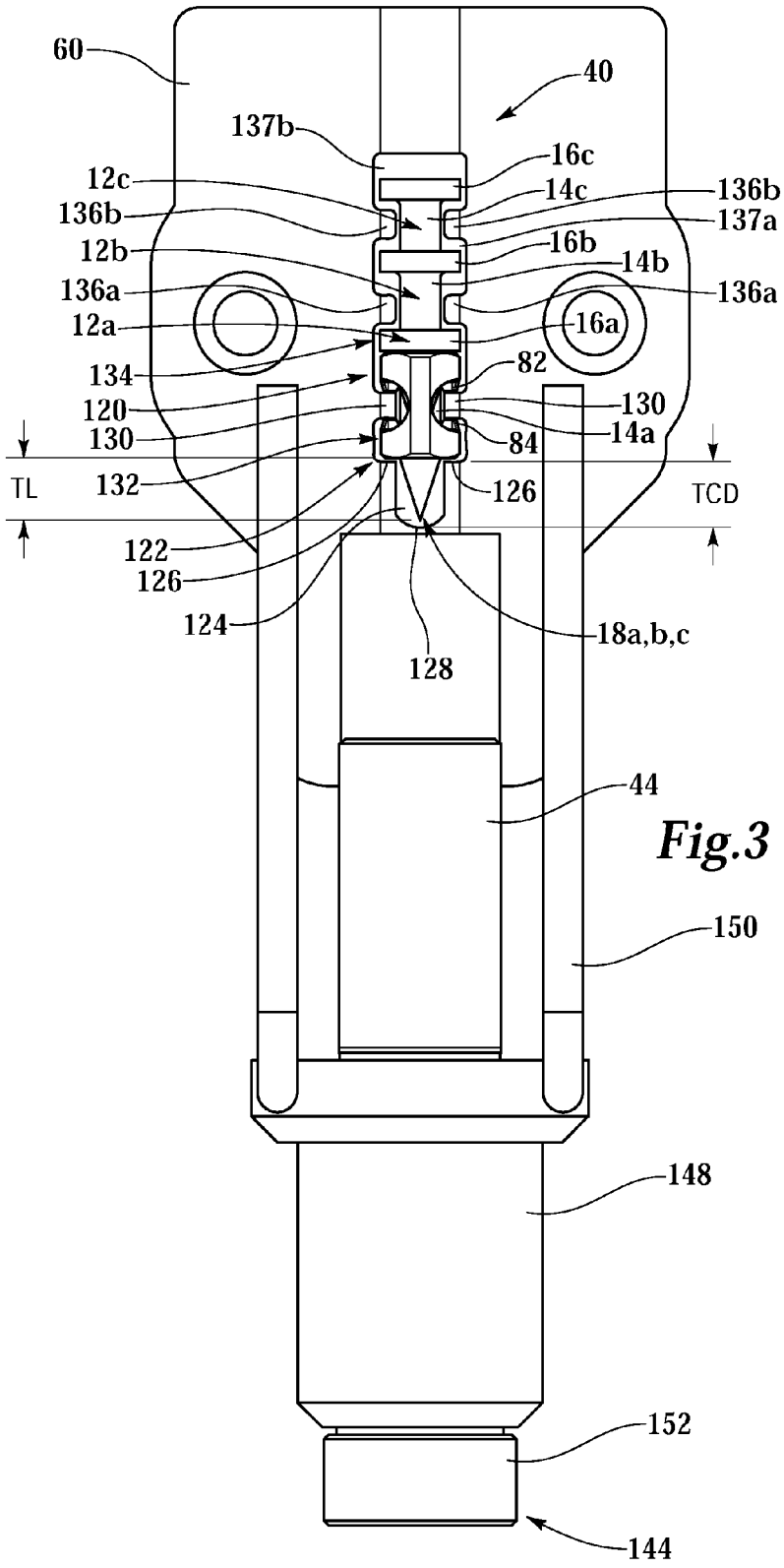
FIG. 3 is a sectional view of a loading opening into a drive bore of the fastener driving tool, taken along line 3-3 in FIG. 1.

Turning to FIG. 3, in another aspect, loading opening 40 into drive bore 38 has a main channel 120 and a tip channel 124 protruding a predetermined channel depth TCD from main channel 120, wherein the predetermined tip channel depth TCD is slightly larger than a predetermined exposed tip length TL between tip 18*a*, 18*b*, 18*c* of fastener 12*a*, 12*b*, 12*c* and a front end 74 of a corresponding collation sleeve 58 that is holding fastener 12*a*, 12*b*, 12*c*, so that there is a small clearance through which tips 18*a*, 18*b*, 18*c* can pass, wherein main channel 120 is long enough to accommodate fasteners 12*a*, 12*b*, 12*c* of at least two different lengths FL.

Figure 8A:
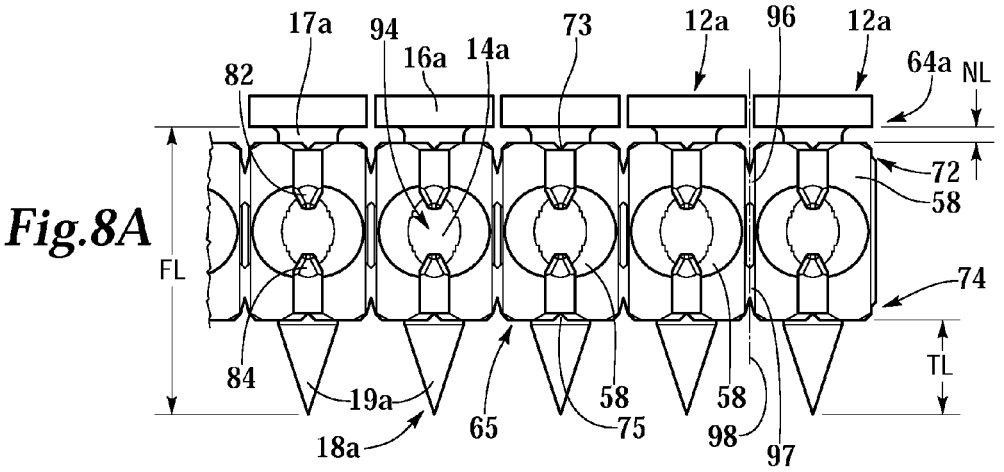
FIG. 8A is a side view of a first collation of the present invention, wherein the first collation holds short fasteners.
Figure 8B:
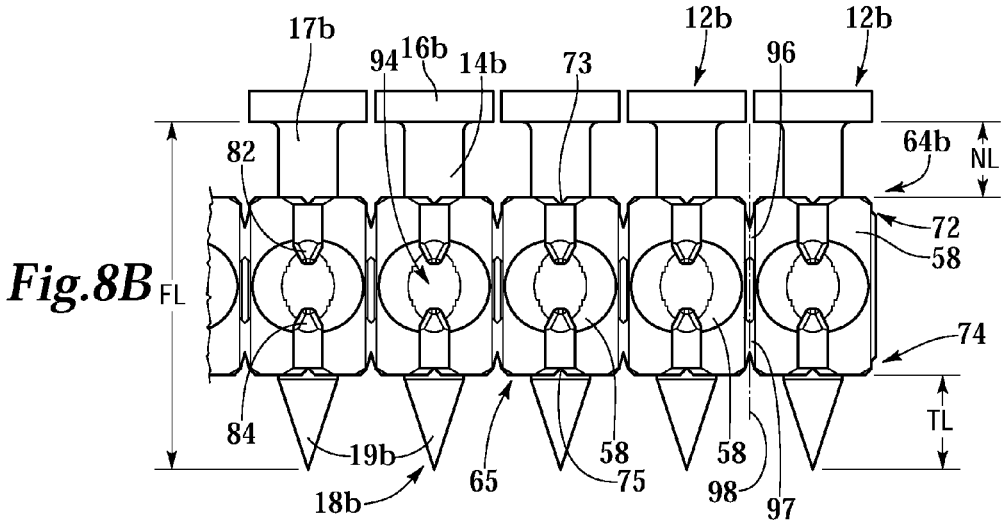
FIG. 8B is a side view of a second collation that holds medium fasteners.
Figure 8C:
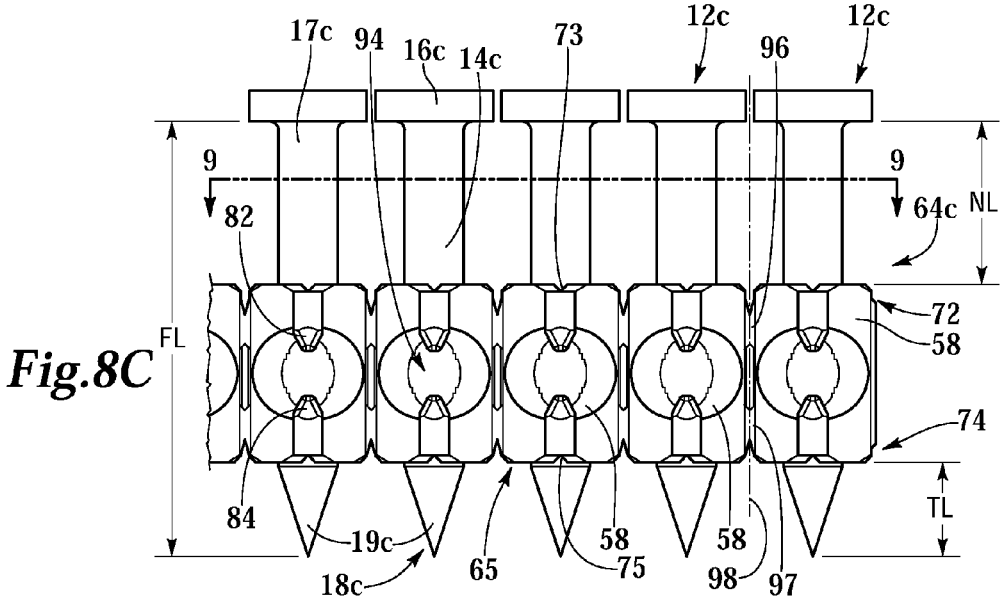
FIG. 8C is a side view of a third collation that holds long fasteners.

As shown in FIGS. 8A-8C, collation 64*a*, 64*b*, 64*c* is provided for transporting fasteners 12*a*, 12*b*, 12*c* along rails 86 disposed within magazine 42. Collation 64*a*, 64*b*, 64*c* includes a plurality of sleeves 58 for supporting and carrying fasteners 12*a*, 12*b*, 12*c* through magazine 42. Each sleeve 58 has a length of between about ¼ inch and about 0.4 inch, and each fastener 12*a*, 12*b*, 12*c* has a predetermined exposed tip length TL from said sleeve 58 of between about ⅛ inch and about ¼ inch. A plurality of frangible bridges 96, 97 are also provided integrally connecting sleeves 58 together in a serial array, and facilitating separation of a leading sleeve 58 from the remaining sleeves 58 when driver blade 32 drives a leading fastener 12*a*, 12*b*, 12*c* held within the leading sleeve 58. Fasteners 12*a*, 12*b*, 12*c* having various lengths FL, as shown in FIGS. 8A-8C, may be used by tool 10, wherein different length FL fasteners are used for different applications. In one embodiment, fasteners having a length FL of between about ¾ inch and about 1 inch are used in collations 64*a*, 64*b*, 64*c*.

Tool 10 drives fasteners 12*a*, 12*b*, 12*c* for fastening a work piece 4 to a substrate 2. Preferably, tool 10 is designed for fastening work piece 4 to a hard substrate 2, such as concrete or steel used in commercial construction. Work piece 4 may be thin, such as thin sheet steel, or work piece 4 may be relatively thick, such as plywood. In one embodiment, tool 10 is used to drive fasteners 12*a*, 12*b*, 12*c* to anchor metal tracking, see FIG. 2, to concrete floors, ceilings or walls, wherein studs are attached to the tracking in order to mount drywall to the studs to build walls.

1 Tool Overview

Returning to FIGS. 1 and 2, tool 10 includes a body 20 having a front end 22 and a rear end 24, with a handle 46 depending from body 20 for a user to hold tool 10. A trigger 48 is mounted to handle 46 for actuating tool 10. Tool 20 encloses a cylinder 26 having an axis 28, wherein a reciprocating piston 30 is mounted within cylinder 26 so that piston 30 is coaxial with cylinder 26 and so that piston 30 slides within cylinder 26. Piston 30 is driven axially forwardly toward front end 22 by a pressurized gas to the rear of piston 30. A power source is included to provide the pressurized gas to drive piston 30 axially forwardly in the driving direction. The power source may provide pressurized gas pneumatically using pressurized air fed to a pneumatic cylinder (not shown), by combustion of fuel in a combustion chamber 34, or by exploding powder in a powder actuated tool. Because tool 10 is preferably designed for driving fasteners 12*a*, 12*b*, 12*c* into a hard substrate, such as concrete or steel, in one embodiment, shown in FIGS. 1 and 2, the power source is a combustion chamber 34 for combusting fuel to provide the large force needed to drive fasteners 12*a*, 12*b*, 12*c* into concrete or steel.

Tool 10 may also include a combustion chamber sleeve 50 mounted in tool body 20 in a sliding manner so that sleeve 50 is movable between an open position (FIG. 1) and a closed position (FIG. 2). When sleeve 50 is in the open position, combustion chamber 34 is also open and tool 10 cannot be fired. When sleeve 50 is moved into the closed position, it closes combustion chamber 34, so that when tool 10 is fired, the pressurized gas acts to drive piston 30 in the driving direction. Combustion chamber sleeve 50 is operatively connected to fastener guide 44 of tool 10 (described below), so that when fastener guide 44 is pushed against a work surface 6, it pushes sleeve 50 into the closed position, which closes combustion chamber 34, allowing tool 10 to be fired only when fastener guide 44 is pushed against work surface 6.

Continuing with FIGS. 1 and 2, driver blade 32 extends forwardly from piston 30 so that driver blade 32 is driven forwardly along with piston 30. In one embodiment, driver blade 32 is a separate piece that is mounted to piston 30, allowing driver blade 32 to be manufactured separately from piston 30. Driver blade 32 has a leading end 52 that strikes fastener head 16*a*, 16*b*, 16*c* to drive fastener 12*a*, 12*b*, 12*c* toward a work surface 6 on work piece 4. Preferably, driver blade 32 is generally cylindrical so that it corresponds to fastener head 16*a*, 16*b*, 16*c* and drive bore 38.

A resilient buffer 54 is located at leading end 56 of cylinder 26 to protect piston 30 and cylinder 26 from damage by absorbing shock from piston 30. Buffer 54 may be made from a resilient plastic, and preferably is made from urethane or rubber.

Turning to FIGS. 1, 2, 6, and 7, a nosepiece 36 extends forwardly from front end 22 of tool body 20, wherein nosepiece 36 encloses drive bore 38 to guide fasteners 12*a*, 12*b*, 12*c* and driver blade 32 toward work surface 6. Loading opening 40 preferably has a geometry that permits fastener 12*a*, 12*b*, 12*c* and its corresponding sleeve 58 to pass through loading opening 40 and into drive bore 38 only when fastener 12*a*, 12*b*, 12*c* and sleeve 58 are oriented properly. Preferably, loading opening 40 also has a geometry that eliminates the exit for short fasteners in order to prevent their tips from diving back out of drive bore 38.

In one embodiment, nosepiece 36 includes an axially extending generally semi-circular groove which makes up part of drive bore 38. A shear block 60 is mounted to nosepiece 36, wherein shear block 60 also includes an axially extending generally semi-circular groove that corresponds to and is registered with the semi-circular groove of nosepiece 36 so that the semi-circular grooves form drive bore 38 so that both nosepiece 36 and shear block 60 guide fasteners 12*a*, 12*b*, 12*c* and driver blade 32 toward work piece 4 and substrate 2. Preferably, shear block 60 is removable, allowing a user to perform maintenance on tool 10, such as clearing out jams in drive bore 38. Preferably, shear block 60 includes loading opening 40 so that shear block 60 guides fasteners 12*a*, 12*b*, 12*c* into drive bore 38.

2 Collations

Turning to FIGS. 8A-8C and 9, different collations 64*a*, 64*b*, 64*c* may be provided for different applications. For example, a first collation 64*a* holds short fasteners 12*a*, which are used for one application, wherein each fastener 12*a* has a tip 18*a* that is located at a predetermined position relative to front end 74 of sleeve 58. A second collation 64*b* holds medium fasteners 12*b* which may be used for another application, wherein each fastener 12*b* has a tip 18*b* that is located at the same predetermined position relative to front end 74. Similarly, a third collation 64*c* holds long fasteners 12*c*, which may be used for yet another application, wherein each fastener 12*c* has a tip 18*c* that is located at the same predetermined position relative to front end 74. Preferably, each fastener tip 18*a*, 18*b*, 18*c* protrudes beyond front end 74 so that each fastener 12*a*, 12*b*, 12*c* has a predetermined tip length TL.

Each collation 64*a*, 64*b*, 64*c* includes a carrier 65 fabricated from a suitable polymeric material. In one embodiment, carrier 65 is molded from a plastic, and preferably from polypropylene. Carrier 65 comprises a plurality of sleeves 58 arranged substantially in a linear row, wherein each sleeve 58 includes a rear end 72 and a front end 74, with a bore 76 extending between rear end 72 and front end 74 for receiving a corresponding fastener 12*a*, 12*b*, 12*c*. Collation 64*a*, 64*b*,

64*c* is manufactured by first molding carrier 65 of sleeves 58, which are connected together in a row, followed by inserting fasteners 12*a*, 12*b*, 12*c* into sleeves 58 to create collation 64*a*, 64*b*, 64*c*. Adjacent sleeves 58 of collation 64*a*, 64*b*, 64*c* are integrally connected together by at least one bridge 96, 67, and in one embodiment, adjacent sleeves 58 are connected together by an upper bridge 96 and a lower bridge 97.

Preferably, carrier 65 is substantially symmetrical about both a horizontally oriented axis and a vertically oriented axis so that carrier 65 may be properly used within magazine 42 of a fastener driving tool 10 regardless of whether or not the carrier 65 is effectively rotated 180° around either axis so that what was formerly the upper end of a sleeve is now the lower end, and what was formerly the leading sleeve is now the trailing sleeve. Also, symmetrical objects are easier to mold, and hence simplify the process of manufacturing carrier 65. However, carrier 65 can also be unsymmetrical if desired. Collation 64*a*, 64*b*, 64*c* may have between about five and about fifty sleeves 58 arranged in a linear row, preferably between about ten and about twenty sleeves 58, still more preferably about fifteen sleeves 58.

2.1 Fasteners

Continuing with FIGS. 8A-8C, preferably, fasteners 12*a*, 12*b*, 12*c* are used to fasten a work piece 4, such as the metal track shown in FIG. 2, to a hard substrate 2, such as concrete or steel used in commercial construction. Each fastener 12*a*, 12*b*, 12*c* has an elongate shank 14*a*, 14*b*, 14*c* with a head 16*a*, 16*b*, 16*c* at one end and a tip 18*a*, 18*b*, 18*c* at the opposite end. Fastener 12*a*, 12*b*, 12*c* includes an ogive 19*a*, 19*b*, 19*c* that tapers from the end of shank 14*a*, 14*b*, 14*c* to tip 18*a*, 18*b*, 18*c*, wherein ogive 19*a*, 19*b*, 19*c* is generally conical in shape. Fasteners 12*a*, 12*b*, 12*c* are drive pins made from metal that provide sufficient tensile strength, toughness, and durability to be driven through work piece 4 and into a hard substrate 2, which may be concrete or steel, without bending or breaking. In one embodiment, fasteners 12*a*, 12*b*, 12*c* are made from a heat treated high carbon steel alloy, preferably from an AISI 1060-1065 steel alloy that is heat treated with an austemper process to a core hardness of between about 52 and about 56 Rockwell C hardness. Fasteners 12*a*, 12*b*, 12*c* may also be made from stainless steel alloys for corrosion resistance, or other metals or metal alloys.

Fasteners 12*a*, 12*b*, 12*c* which are used for driving into concrete or steel preferably have a shank diameter of between about 1/16 inch and about 3/16 inch, preferably between about 0.1 inch and about 0.15 inch, still more preferably about 1/8 inch and a head diameter of between about 1/8 inch and about 3/8 inch, preferably between about 0.2 inch and about 0.3 inch, still more preferably about 1/4 inch.

The length FL of fasteners 12*a*, 12*b*, 12*c* depends on the desired application. For example, short fasteners 12*a*, shown in FIG. 8A, having a length FL (measured between tip 18*a* and the bottom of head 16*a*) of between about 1/4 inch and about 5/8 inch, preferably between about 3/8 and about 9/16, still more preferably about 1/2 inch, are used to attach thin metal work pieces 4, such as the metal track shown in FIG. 2, to a hard substrate 2, such as concrete or steel. Short fastener 12*a* is preferred for this type of application because relatively short fasteners have a relatively high column strength in their shanks, which allows short fastener 12*a* to withstand the high force needed to drive fastener 12*a* though metal work piece 4 and into the hard substrate 2. Short fastener 12*a* may also be used if an application does not require a higher holding strength that may be provided by longer fasteners.

Longer fasteners, such as medium fasteners 12*b*, shown in FIG. 8B, having a length FL of between about 5/8 inch and about 7/8 inch, preferably between about 11/16 inch and about 13/16 inch, still more preferably about 3/4 inch, or long fasteners 12*c*, shown in FIG. 8C, having a length FL between about 7/8 inch and about 2 inches, preferably between about 15/16 inch and about 1 1/2 inch, still more preferably about 1 inch, have smaller column strengths than short fastener 12*a*, so that longer fasteners 12*b*, 12*c* may not be ideal for fastening a thin metal work piece 4 to hard concrete or steel because shank 14*b*, 14*c* is more likely to bend or break. Also, tool 10 may need more driving power to drive longer fasteners 12*b*, 12*c* into a hard substrate 2, particular a thick substrate 2 such as concrete, but longer fasteners 12*b*, 12*c* may provide more holding strength once they are installed. However, thicker work pieces, such as plywood (not shown), may accommodate longer fasteners 12*b*, 12*c* because the thicker work piece acts to brace longer shanks 14*b*, 14*c* to compensate for their smaller column strength. Also, longer shanks 14*b*, 14*c* are needed to extend through thicker work pieces and into the substrate, so that the work piece and substrate and fastened together.

In one system for use with concrete or steel substrates 2, three sets of collations 64*a*, 64*b*, 64*c* carrying fasteners 12*a*, 12*b*, 12*c* are provided having nominal lengths of 1/2 inch (short fasteners 12*a*), 3/4 inch (medium fasteners 12*b*), and 1 inch (long fasteners 12*c*), so that a user may select which fasteners 12*a*, 12*b*, 12*c* are appropriate for a given application.

2.1.1 Position of Tip

Continuing with FIGS. 8A-8C, in one embodiment, each fasteners 12*a*, 12*b*, 12*c* has a tip 18*a*, 18*b*, 18*c* that is located at a predetermined position relative to front end 74 of sleeve, preferably so that there is a small exposed tip length TL, which may include part of all of ogive 19*a*, 19*b*, 19*c* and tip 18*a*, 18*b*, 18*c*, and also may include part of shank 14*a*, 14*b*, 14*c*. Preferably, the position of tip 18*a*, 18*b*, 18*c* is substantially uniform regardless of what length FL of fastener 12*a*, 12*b*, 12*c* is used. As shown in FIGS. 8A-8C, exposed tip length TL of short fastener 12*a* is the same as exposed tip length TL of medium fastener 12*b*, and the same exposed tip length TL of long fasteners 12*c*.

Also, preferably, the predetermined exposed tip length TL between front sleeve end 74 and corresponding fastener tip 18*a*, 18*b*, 18*c* is as small as possible without affecting the alignment of fastener 12*a*, 12*b*, 12*c* within sleeve 58 so that sleeve 58 provides guidance to tip 18*a*, 18*b*, 18*c* as fastener 12*a*, 12*b*, 12*c* is driven toward work surface 6 so that the likelihood that fastener tip 18*a*, 18*b*, 18*c* will begin to dive back toward magazine 42 is reduced. The close spacing of front sleeve end 74 and fastener tip 18*a*, 18*b*, 18*c* helps prevent fasteners 12*a*, 12*b*, 12*c* from diving back into magazine 42 because it allows tool 10 to be configured to remove the exit path that may allow fastener tip 18*a*, 18*b*, 18*c* to exit drive bore 38 through loading opening 40, described below. Also, because of the small predetermined exposed tip length TL, sleeves 58 provide guidance to tips 18*a*, 18*b*, 18*c* as fastener 12*a*, 12*b*, 12*c* is driven toward work surface 6 so that the likelihood that fastener tip 18*a*, 18*b*, 18*c* will begin to dive back toward magazine is reduced. In addition, sleeve 58 aligns tip 18*b*, 18*c* of longer fasteners 12*b*, 12*c* with axis 28 so that tips 18*b*, 18*c* remain centered in bore when the leading sleeve 58 is sheared from the second sleeve 58, and tip 18*b*, 18*c* is captured by fastener guide 44.

The predetermined position of tip 18*a*, 18*b*, 18*c* relative to front sleeve end 74 is selected so that tip 18*a*, 18*b*, 18*c* is positioned in a zone relative to front sleeve end 74 between fastener tip 18*a*, 18*b*, 18*c* being slightly recessed within bore 76, i.e. about 0.05 inch behind front end 74 and a position that protrudes from sleeve 58 so that an exposed tip length TL is formed. Fastener tip 18*a*, 18*b*, 18*c* may be flush with front end 74 or recessed within sleeve bore 76, however, it may be difficult to ensure the alignment of fastener 12*a*, 12*b*, 12*c* and the support of fastener shank 14*a*, 14*b*, 14*c* if tip 18*a*, 18*b*, 18*c* is recessed within bore 76, therefore, for practical reasons, in one embodiment front sleeve end 74 is positioned within this zone so that tip 18*a*, 18*b*, 18*c* has an exposed tip length TL below front sleeve end 74. In one embodiment, the predetermined position of tip 18*a*, 18*b*, 18*c* is located between about 0.1 inch behind front end 74 of sleeve 58 and about ½ inch beyond front end 74, preferably between about 0.05 inch behind front end 74 and about ¼ inch beyond front end 74, and still more preferably so that tip 18*a*, 18*b*, 18*c* has an exposed tip length TL of about 0.2 inch.

In one embodiment, collations 64*a*, 64*b*, 64*c* are manufactured by inserting fasteners 12*a*, 12*b*, 12*c* through sleeve bores 76, and fastener tips 18*a*, 18*b*, 18*c* may be placed within a manufacturing tolerance of about 0.025 inch from the desired exposed tip length TL. For example, if the desired exposed tip length TL is about 0.205 inch, then during manufacturing of collations 64*a*, 64*b*, 64*c*, fastener tips 18*a*, 18*b*, 18*c* should be placed between about 0.18 inch and about 0.23 inch from front sleeve ends 74.

2.1.2 Exposed Neck Length

Continuing with FIGS. 8A-8C, because the exposed tip length TL of fasteners 12*a*, 12*b*, 12*c* may be uniform regardless of the length FL of fastener 12*a*, 12*b*, 12*c* that is used, the length NL of an exposed neck 17*a*, 17*b*, 17*c* of fasteners 12*a*, 12*b*, 12*c* will vary depending on the length FL of fastener being used. For example, for short fasteners 12*a* having a length FL of between about ¼ inch and about ¾ inch, neck 17*a* has a length NL of between about 0 inch, wherein head 16*a* is abutted against rear end 72, and about 0.05 inch, preferably between about 0.001 inch and about 0.02 inch, still more preferably about 0.005. For longer fasteners, such as medium fasteners 12*b* or long fasteners 12*c*, the exposed neck length NL is preferably between about 0.2 inch and about 1 ½ inch. In one embodiment, for medium fasteners 12*b* having a length FL of about ¾ inch, neck 17*b* has a length NL of between about 0.1 inch and about ⅜ inch, preferably between about 0.2 inch and about ¼ inch, still more preferably about 0.22 inch, and for long fastener 12*c* having a length FL of about 1 inch, neck 17*c* has a length NL of between about ⅜ inch and about ¾ inch, preferably between about 0.4 inch and about ⅝ inch, still more preferably about 0.47 inch.

Also, for longer fasteners 12*b*, 12*c*, it is preferred that the exposed neck length NL be approximately at least as long as exposed tip length TL, and for long fasteners 12*c*, approximately at least twice as large as exposed tip length TL.

2.2 Sleeves

Continuing with FIGS. 1 and 8A-8C, fasteners 12*a*, 12*b*, 12*c* are collated in a row by collation 64*a*, 64*b*, 64*c* which includes a plurality of collation sleeves 58 connected together in series, wherein each sleeve 58 holds and supports a fastener 12*a*, 12*b*, 12*c*. Collation 64*a*, 64*b*, 64*c* provides a plurality of fasteners 12*a*, 12*b*, 12*c* connected together as a single unit, which is easier for a user of tool 10 to manipulate. Collation 64*a*, 64*b*, 64*c* also provides proper spacing between adjacent fasteners 12*a*, 12*b*, 12*c* to ensure that tool 10 only drives one fastener 12*a*, 12*b*, 12*c* at a time. The width across sleeve 58 is preferably about the same as the diameter of fastener heads 16*a*, 16*b*, 16*c* so that both sleeve 58 and fastener head 16*a*, 16*b*, 16*c* help guide fastener 12*a*, 12*b*, 12*c* as it is driven through drive bore 38. Each sleeve may have a width of between about ⅛ inch and about ⅜ inch, preferably between about 0.2 inch and about 0.3 inch, still more preferably about 0.27 inch.

Collation 64*a*, 64*b*, 64*c* sequentially feeds fasteners 12*a*, 12*b*, 12*c* through loading opening 40 into drive bore 38 via a magazine 42 so that a leading fastener 12*a*, 12*b*, 12*c* is positioned within drive bore 38 to be driven by driver blade 32. As the leading fastener 12*a*, 12*b*, 12*c* is driven through drive bore 38 by driver blade 32, its corresponding leading sleeve 58 is sheared from a second adjacent sleeve 58. The leading fastener 12*a*, 12*b*, 12*c* and sleeve 58 are driven through drive bore 38 toward work surface 6 on work piece 4. As fastener 12*a*, 12*b*, 12*c* is driven into work piece 4 and substrate 2, sleeve 58 is split apart so that it separates from fastener 12*a*, 12*b*, 12*c* or sleeve 58 becomes trapped under fastener head 16*a*, 16*b*, 16*c*. In one embodiment, each sleeve 58 includes a pair of generally V-shaped notches 73 at rear sleeve end 72 and a pair of generally V-shaped notches 75 at front sleeve end 74 so that fastener 12*a*, 12*b*, 12*c* will readily split sleeve 58 as fastener head 16*a*, 16*b*, 16*c* is driven through sleeve 58. After the leading fastener 12*a*, 12*b*, 12*c* has been driven, the spring force of a spring biased follower (not shown) in magazine 42 pushes the second fastener 12*a*, 12*b*, 12*c* into drive bore 38 so that the second fastener 12*a*, 12*b*, 12*c* becomes the leading fastener, and a third fastener becomes the second fastener.

Continuing with FIGS. 8A-8C, adjacent sleeves 58 of collation 64*a*, 64*b*, 64*c* are connected with one or more frangible bridges 96. Bridges 96 are designed to be sheared when the leading fastener 12*a*, 12*b*, 12*c* held within the leading sleeve 58*a* is driven by driver blade 32 so that the leading sleeve 58 is sheared from the second sleeve 58 along a breaking plane 98 located at the juncture between bridges 96 of the leading sleeve 58 and adjacent bridges 96 of the second sleeve 58. Bridges 96, 97 may be dimensioned to maximize fastener density while avoiding jamming and improving guidance, e.g., the distance between sleeves 58 may be between about 3% and about 20%, preferably between about 5% and about 12% of the in-line thickness of sleeve 58.

Each sleeve 58 ensures that corresponding fastener 12*a*, 12*b*, 12*c* is coaxially aligned within drive bore 38 of tool 10, so that fasteners 12*a*, 12*b*, 12*c* are driven substantially perpendicularly with respect to work surface 6, otherwise fastener 12*a*, 12*b*, 12*c* may bend or be driven crooked, preventing proper fastening of work piece 4 to substrate 2, or fastener 12*a*, 12*b*, 12*c* may ricochet off of the substrate 2 due to the hardness of substrate 2 and the force in which fastener 12*a*, 12*b*, 12*c* is driven.

Each fastener 12*a*, 12*b*, 12*c* is inserted through a corresponding sleeve 58 of carrier 65 so that fastener 12*a*, 12*b*, 12*c* has a predetermined exposed tip length TL from front end 74 of the corresponding sleeve 58, and head 16*a*, 16*b*, 16*c* is spaced a predetermined distance NL from rear end 72 of the corresponding sleeve 58. Each sleeve 58 has a predetermined axial length that is long enough to properly align and support fastener 12*a*, 12*b*, 12*c*, yet not so long as to be overly expensive. In one embodiment, the predetermined axial length of each sleeve 58 is between about ⅛ inch and about ½ inch, preferably between about ¼ inch and about 0.4 inch, still more preferably about 0.32 inch. In one embodiment, each sleeve 58 includes a plurality of protrusions, such as collars 78, 80, integrally provided upon sleeve 58 for engaging rails 86 within magazine 42.

Figure 9:
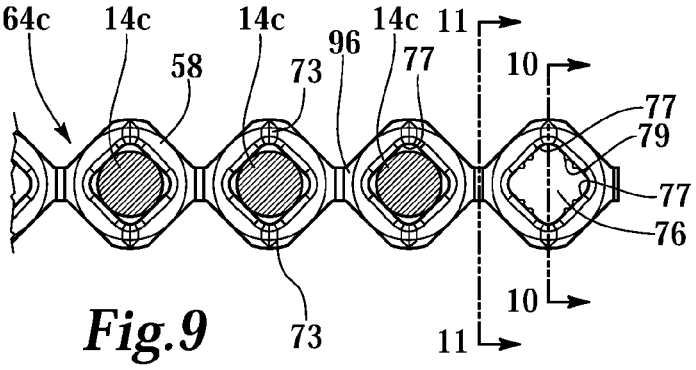
FIG. 9 is an elevation view of collations, taken along line 9-9 in FIG. 8C.

Sleeves 58 may be formed into one of many geometric shapes, including cylindrical, but in one embodiment, shown in FIG. 9, each sleeve 58 has a substantially square-shaped cross section and sleeve bore 76 also has a substantially square-shaped cross section with interior side walls 77, while fastener shanks 14*a*, 14*b*, 14*c* have a substantially circular cross section. A portion of each fastener shank 14*a*, 14*b*, 14*c* will engage a corresponding interior side wall 77 of a corresponding sleeve 58 at a substantially central portion of interior side wall 77 and along a substantially vertically oriented locus along interior side wall 77 (shown as long fastener shank 14*c* in FIG. 9). In one embodiment, each interior side wall 77 includes one or more crush ribs or dimples 79, best shown in FIGS. 9 and 10, to accommodate fastener shanks 14*a*, 14*b*, 14*c*, which have a predetermined diameter within machined tolerances. Sleeves 58 may be dimensioned to maximize fastener density while avoiding jamming and improving guidance, e.g., each sleeve 58 may have an in-line thickness and a transverse thickness that is approximately equal to, e.g. between about 95% and about 110%, of the diameter of fastener heads 16*a*, 16*b*, 16*c* with close spaces provided by bridges 96, 97.

Figure 10:
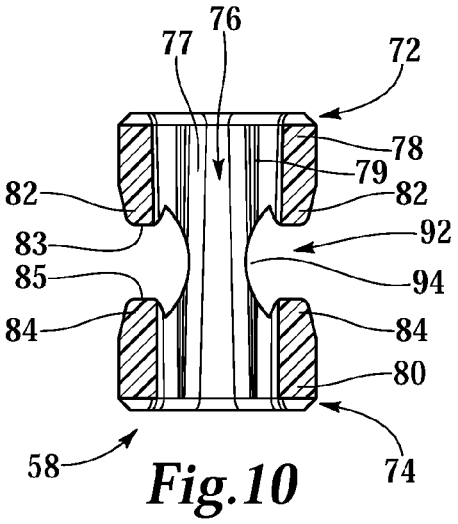
FIG. 10 is a sectional view of a sleeve of the collation, taken along line 10-10 in FIG. 9.
Figure 11:
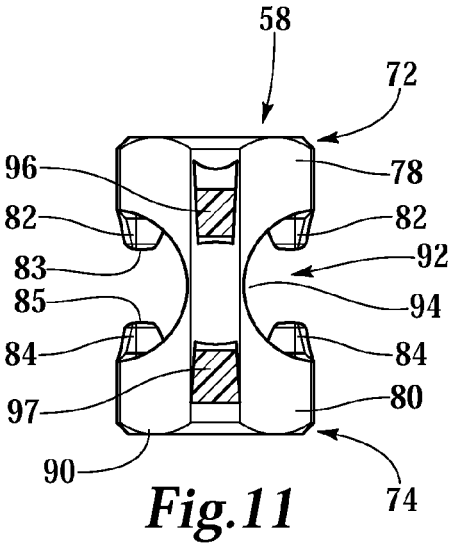
FIG. 11 is a sectional view of a sleeve taken along line 11-11 in FIG. 9.

Continuing with FIGS. 10 and 11, in one embodiment, each sleeve 58 includes an upper collar 78 at rear end 72 and a lower collar 80 at front end 74 wherein upper and lower collars 78, 80 protrude laterally outwardly from sleeve 58 so that there is a pair of lateral channels 92 on each side of sleeve 58 between upper collar 78 and lower collar 80. Rails 86 of magazine 42 are received by channels 92 so that rails 86 engage collars 78, 80 and guide collation 64*a*, 64*b*, 64*c* through magazine 42. In one embodiment, a window 94 is included in each channel 92 through which a portion of fastener shank 14*a*, 14*b*, 14*c* emerges. Fasteners 12*a*, 12*b*, 12*c* can also be held together by separate upper and lower collars (not shown), i.e. by a plurality of joined upper collars proximate fastener heads 16*a*, 16*b*, 16*c* and a plurality of separate joined lower collars proximate fastener tips 18*a*, 18*b*, 18*c*.

Preferably, upper and lower collars 78, 80 each include a rail engaging member or projection 82, 84 for engaging rails 86 of magazine 42. In one embodiment, projections 82, 84 protrude toward each other into channels 92. A pair of upper projections 82 protrudes downwardly from upper collar 78, while a pair of lower projections 84 protrudes upwardly from lower collar 80, so that upper projections 82 protrude toward lower projections 84, and lower projections 84 protrude toward upper projections 82. Each upper projections 82 is generally vertically aligned with a corresponding lower projection 84, and conversely each lower projections 84 is generally vertically aligned with a corresponding upper projection 82, so that a space is defined between upper projections 82 and lower projections 84 within which rails 86 of magazine 42 may be accommodated.

In one embodiment, each projection 82, 84 has a substantially pyramidal configuration so that each projection 82, 84 includes a contact tip region 83, 85 for engaging a surface portion of one of magazine rails 86. Preferably, each contact tip region 83, 85 comprises a substantially point-type radiused contact region for engaging rail 86 of magazine 42 so that the frictional forces generated between collation 64*a*, 64*b*, 64*c* and rails 86 are effectively reduced as much as possible so that the conveyance of collation 64*a*, 64*b*, 64*c* through magazine 42 is as smooth as possible to avoid hang-ups.

3 Magazine

Figure 5:
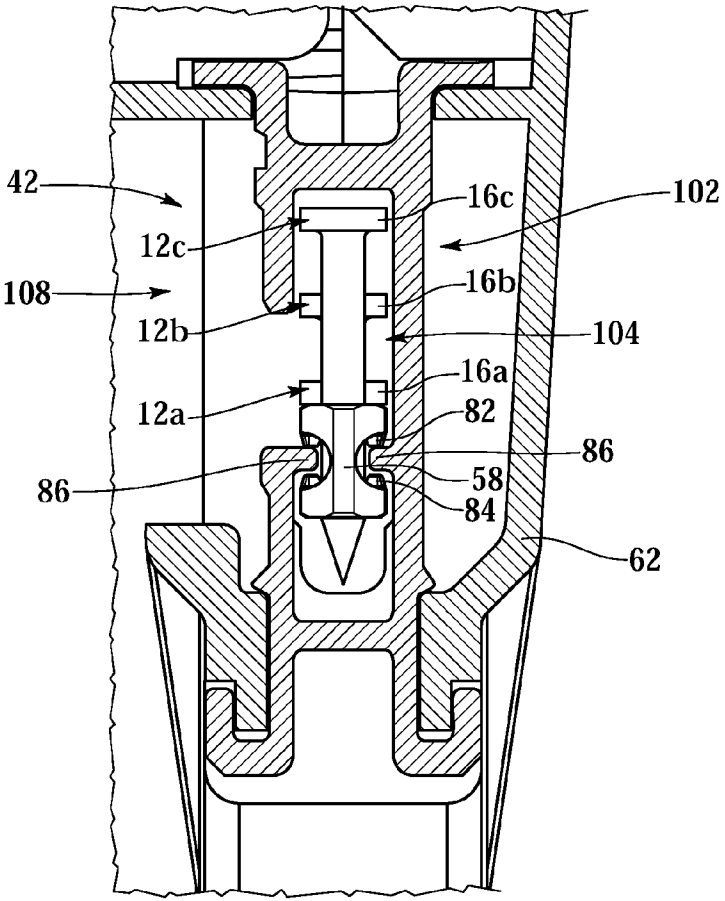
FIG. 5 is a sectional view of a second guidance zone of the magazine, taken along line 5-5 in FIG. 1.
Figure 4:
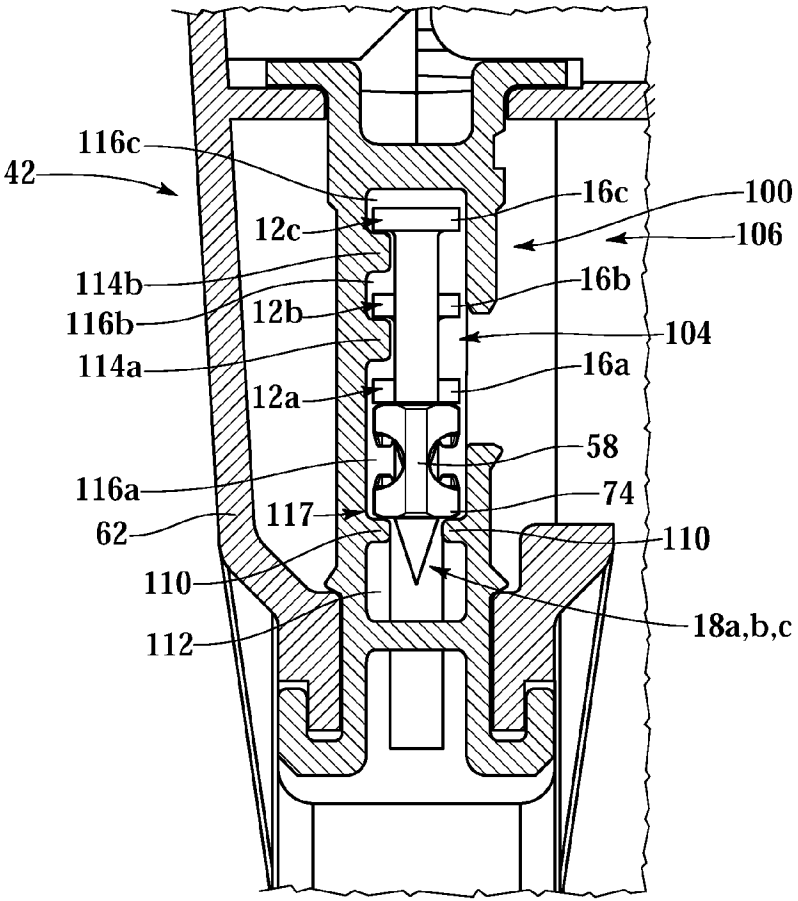
FIG. 4 is a sectional view of a first guidance zone of a magazine of the fastener driving tool, taken along line 4-4 in FIG. 1.

Turning to FIGS. 1, 4 and 5, a magazine 42 is provided to feed fasteners 12*a*, 12*b*, 12*c* to loading opening 40 so that fasteners 12*a*, 12*b*, 12*c* are fed into drive bore 38, where fasteners 12*a*, 12*b*, 12*c* are driven by driver blade 32. Magazine 42 feeds fasteners 12*a*, 12*b*, 12*c* so that they are aligned properly with loading opening 40 and with drive bore 38. Magazine 42 includes a housing 62 configured to receive a collation 64*a*, 64*b*, 64*c* of collated fasteners 12*a*, 12*b*, 12*c*, described below. In one embodiment, magazine housing 62 is mounted to handle 46 and includes a feed end 66 with a slot-like opening through which collations 64*a*, 64*b*, 64*c* are inserted, an exit end 68 having an exit opening which is in alignment or registry with loading opening 40 to allow free and sequential passage of fasteners 12*a*, 12*b*, 12*c* and sleeves 58 through the exit opening and loading opening 40, and into drive bore 38. A spring biased follower (not shown) pushes collation 64*a*, 64*b*, 64*c* of fasteners through magazine 42 toward exit opening 70. Magazine 42 described herein is designed primary to address operational characteristics of fastener collation 64*a*, 64*b*, 64*c*, which is described below.

Magazine 42 includes guidance means that extend between feed end 66 and exit end 68, which preferably is provided with at least two guidance formations, a first guidance formation 100 configured for engaging fastener collation 64*a*, 64*b*, 64*c* at a first location on collation 64*a*, 64*b*, 64*c*, and a second guidance formation 102 configured for engaging collation 64*a*, 64*b*, 64*c* at a second location on collation 64*a*, 64*b*, 64*c*.

Magazine 42 facilitates loading of collations 64*a*, 64*b*, 64*c* so that they do not become caught or jammed in magazine 42, and guiding collation 64*a*, 64*b*, 64*c* to loading opening 40. In this way, magazine 42 defines a feed passageway 104 which extends the full length of magazine 42 from feed end 66 to exit end 68. A first guidance zone 106, which includes first guidance formation 100, begins at feed end 66 and is configured for engaging collation 64*a*, 64*b*, 64*c* at front sleeve ends 74.

3.1 First Guidance Formation

As shown in FIG. 4, in one embodiment, first guidance formation 100 in magazine 42 includes a feed passageway 104 having a collation channel 116*a* for accommodating sleeves 58 and a head channel 116*b* spaced from collation channel 116*a* for accommodating heads 16*a*, 16*b*, 16*c* of fasteners 12*a*, 12*b*, 12*c* having a particular fastener length FL. For example, lower head channel 116*b*, shown in FIG. 4, is positioned to accommodate head 16*b* of medium fastener 12*b*. Additional head channels may be included for heads of fasteners having other lengths, such as head channel 116*c* for heads 16*c* of long fasteners 12*c*.

First guidance formation includes a pair of shoulders 110 that project laterally into feed passageway 104 to provide a track for front sleeve ends 74. Front sleeve ends 74 slidably ride on shoulders 110 while fastener tip 18*a*, 18*b*, 18*c* extends axially between shoulders 110 into a tip channel 112 of feed passageway 104. As described above, it may be desirable to have fastener tip 18*a*, 18*b*, 18*c* be flush with front end 74 or recessed within sleeve bore 76. In this case, a pair of shoulders may not be necessary, but instead a single guidance surface extending across the lower end of feed passageway 104 that supports front sleeve end 74 may be used. The alignment of collation 64*a*, 64*b*, 64*c* is maintained by the spacing between shoulders 110, which allows limited lateral movement of fasteners 12*a*, 12*b*, 12*c*, and hence limited lateral movement of collation 64*a*, 64*b*, 64*c*.

In one embodiment, shown in FIG. 4, strip passageway 104 at first guidance formation 100 includes a collation channel 116*a*, a tip channel 112, a first head channel 116*b* and a second head channel 116*c*. The pair of shoulders 110 are at a forward end 117 of collation channel 116*a* and collation channel 116*a* extends rearwardly from forward end 117 far enough to accommodate sleeve 58. Tip channel 112 protrudes forwardly from forward end 117 of collation channel 116*a*. First head channel 116*b* is spaced rearwardly from collation channel 116*a* by a first rail 114*a*, wherein first head channel 116*b* accommodates head 16*b* of medium fastener 12*b*, but not head 16*a* of short fastener 12*a* or head 16*c* of long fastener 12*c*. Second head channel 116*b* is spaced rearwardly from first head channel 116*a* by a second rail 114*b*, wherein second head channel 116*b* accommodates head 16*c* of long fastener 12*c*, but not head 16*a* of short fastener 12*a* or head 16*b* of medium fastener 12*b*. In one embodiment, collation channel 116*a* is long enough to accommodate sleeve 58 and head 16*a* of short fastener 12*a*, but is not long enough to accommodate heads 16*b*, 16*c* of medium or long fasteners 12*b*, 12*c*. Channels 116*a*, 116*b*, 116*c* are each sized to accommodate a range of fastener lengths FL, and to allow for a manufacturing tolerance when placing fasteners 12*a*, 12*b*, 12*c* into sleeves 58. Head channels 116*b*, 116*c* are shorter than sleeve 58 so that a user cannot accidentally place sleeve 58 in either head channels 116*b*, 116*c*, which may cause collation 64*a*, 64*b*, 64*c* to be located in the wrong position when passing into second guidance zone 108 and loading opening 40, but rather only in collation channel 116*a*.

Preferably, shoulders 110 extend toward feed end 66 of magazine 42 farther than rails 114*a*, 114*b*, as shown in FIG. 1, so that a user may easily load collation 64*a*, 64*b*, 64*c* properly by placing fastener tip 18*a*, 18*b*, 18*c* into tip channel 112 and ensuring that front sleeve ends 74 are abutted against shoulders 110, and then sliding collation 64*a*, 64*b*, 64*c* along magazine 42 toward exit end 68 until fastener heads 16*a*, 16*b*, 16*c* are inserted into the appropriate channel 116*a*, 116*b* or 116*c*. In this way, shoulders 110 provide a frame of reference for the user as to where to place collation 64*a*, 64*b*, 64*c*.

3.2 Second Guidance Formation

Turning to FIG. 5, second guidance zone 108 in magazine 42 provides second guidance formation 102. In a preferred embodiment, second guidance formation includes a pair of rails 86 engaged with channels 92 of sleeves 58 so that projections 82, 84 engage rails 86. Second guidance zone 108 begins adjacent to first guidance zone 106 and extends substantially to exit end 68 of magazine 42 so that second guidance zone 108 accepts fasteners from first guidance zone 106, as shown in FIG. 1. Rails 86 extend laterally into strip passageway 104 so that the distance between rails 86 is smaller than the diameter of upper collars 78 and lower collars 80 so that rails 86 engage projections 82, 84. Rails 86 are spaced from each other to permit free slidability of collation 64*a*, 64*b*, 64*c* lengthwise along strip passageway 104, but only permitting slight lateral movement of collation 64*a*, 64*b*, 64*c*. Rails 86 have a thickness that is slightly smaller than the distance between upper projections 82 and lower projections 84 so that protrusions engage rails 86 along the length of magazine 42 to ensure that sleeves 58 and fasteners are properly aligned with loading opening 40. Because rails 86 are engaged between projections 82, 84, this alignment is maintained even when tool is used in an inverted position, so that collation 64*a*, 64*b*, 64*c* does not shift out of alignment in strip passageway 104. Projections 82, 84 engage rails 86 of magazine 42 so that along a portion of magazine 42 only sleeves 58 are in contact with rails 86. It has been found that when only a small portion of collation sleeves 58, such as projections 82, 84 described above, are in contact with rails 86 as collation 64*a*, 64*b*, 64*c* slides along magazine 42, there is less friction and collation 64*a*, 64*b*, 64*c* more easily slides along magazine 42, preventing collation 64*a*, 64*b*, 64*c* from becoming retarded, "hung-up," or jammed within magazine.

In one embodiment, shown in FIG. 1, first guidance zone 106 overlaps with second guidance zone 108 to form a transition zone 118 where both shoulders 110 and rails 86 briefly engage collation 64*a*, 64*b*, 64*c* to ensure that collation 64*a*, 64*b*, 64*c* has a smooth transition from first guidance zone 106 to second guidance zone 108 so that sleeves 58 do not become hung up on rails 86. In this way, first guidance zone 106 and second guidance zone 108 act in cooperation to ensure that collations 64*a*, 64*b*, 64*c* of fasteners 12*a*, 12*b*, 12*c* are properly loaded into magazine 42 and to ensure that collations 64*a*, 64*b*, 64*c* are properly aligned with loading opening 40.

4 Loading Opening

Turning now to FIG. 3, as described above, preferably, tool 10 is designed to accommodate different collations 10*a*, 10*b*, 10*c* and fasteners 12*a*, 12*b*, 12*c* of different lengths FL for use in different applications. Therefore, preferably, fastener driving tool 10 is designed to accommodate the different fastener lengths FL associated with the fasteners of the different collations. For this purpose, magazine 42 and loading opening 40 must be axially long enough to accommodate the longest fasteners 12*a*, 12*b*, 12*c* that are to be driven by tool 10.

Collations 64*a*, 64*b*, 64*c* may have a substantially uniform exposed tip length TL of fasteners 12*a*, 12*b*, 12*c*, regardless of the length FL of fastener 12*a*, 12*b*, 12*c* being used. Uniform exposed tip length TL only requires loading opening 40 to be long enough below sleeve 58 to allow fastener tips 18*a*, 18*b*, 18*c* to pass through loading opening 40. Therefore, loading opening 40 accommodates heads 16*a*, 16*b*, 16*c* of fasteners 12*a*, 12*b*, 12*c* having various lengths by being long enough above collation sleeves 58 to allow for fastener heads 16*a*, 16*b*, 16*c* located at different positions relative to sleeves 58. The length of the channel 124 of loading opening 40 that accommodates tip 18*a*, 18*b*, 18*c* only needs to be long enough to allow the uniform length of fastener tips 18*a*, 18*b*, 18*c* that extend below lower end of collation sleeve 58, which effectively eliminates the exit of short fastener tips 18*a* so that they may be prevented from diving back into magazine 42.

Continuing with FIG. 3, loading opening 40 includes a main channel 120 for accommodating sleeves 58 and fastener heads 16*a*, 16*b*, 16*c*, and a tip channel 124 protruding forwardly from a forward end 122 of main channel 120 for accommodating fastener tips 18*a*, 18*b*, 18*c*. There is a pair of shoulders 126 at forward end 122 of main channel 120 for guiding front sleeve ends 74. Shoulders 126 support front end 74 of the second sleeve 58, shown in FIGS. 6 and 7, as the leading fastener 12*a*, 12*b*, 12*c* and the leading sleeve 58 are driven to ensure that there is a clean break between the leading sleeve 58 and the second sleeve 58. Shoulders 126 are substantially aligned with shoulders 110 of first guidance zone 106 in magazine 42.

4.1 Tip Channel of Loading Opening

Continuing with FIG. 3, tip channel 124 protrudes from main channel 120 for a predetermined tip channel depth TCD from shoulders 126, wherein the predetermined tip channel depth TCD is slightly larger than the uniform exposed tip length TL so that there is a small clearance between a forward end 128 of tip channel 124 and fastener tips 18*a*, 18*b*, 18*c*, allowing fastener tips 18*a*, 18*b*, 18*c* to pass through tip channel 124. Tip channel 124 has a shape that substantially corresponds to the profile of ogive 19*a*, 19*b*, 19*c*. In one embodiment, fasteners 12*a*, 12*b*, 12*c* have generally conical ogives 19*a*, 19*b*, 19*c*, and tip channel 124 is generally parabolic, as shown in FIG. 3, however, tip channel 124 may have a pointed shape that substantially matches the conical shape of ogive 19*a*, 19*b*, 19*c*. Main channel 120 of loading opening 40 is long enough to accommodate the longest fasteners 12*a*, 12*b*, 12*c* that are intended to be driven by tool 10.

Uniform exposed tip length TL of fasteners 12*a*, 12*b*, 12*c*, along with tip channel depth TCD of tip channel 124 of loading opening 40, allow tool 10 to discourage dive back of fasteners 12*a*, 12*b*, 12*c* into magazine 42 because fastener tips 18*a*, 18*b*, 18*c* do not have enough space or time to angle toward magazine 42 to pass back through loading opening 40. Even if fastener tip 18*a*, 18*b*, 18*c* starts to dive back toward magazine 42, it is redirected by drive bore 38 toward work surface 6.

In one embodiment, the depth TCD of tip channel 124 in loading opening 40 is larger than the uniform exposed tip length TL, but tip channel depth TCD should be as close to the uniform exposed tip length TL as possible to ensure that there is not enough space to form an exit for fastener tips 18*a*, 18*b*, 18*c*. In one embodiment, tip channel depth TCD is longer than the uniform exposed tip length TL by just enough to account for the expected manufacturing tolerance of the positioning of fastener tips 18*a*, 18*b*, 18*c*. In one embodiment, fasteners 12*a*, 12*b*, 12*c* may be inserted into sleeves 58 so that the exposed tip length TL is within about 0.025 inch of the desired uniform exposed tip length TL. For example, if the desired uniform exposed tip length TL is about 0.205 inch, than during manufacturing of collations 64*a*, 64*b*, 64*c*, fastener tips 18*a*, 18*b*, 18*c* should be placed between about 0.18 inch and about 0.23 inch from front sleeve ends 74. Therefore, in order to accommodate fasteners tips 18*a*, 18*b*, 18*c* in a collation 64*a*, 64*b*, 64*c* where the desired uniform exposed tip length TL is 0.205 inch, the predetermined channel depth TCD of tip channel 124 is preferably slightly larger than about 0.23 inch, e.g. about 0.235 inch, to ensure that tip channel 124 is longer than the longest expected exposed tip length TL while still having a close clearance between fastener tip 18*a*, 18*b*, 18*c* and forward end 128 of tip channel 124.

The predetermined channel depth TCD of tip channel 124 is preferably between about 0 inch, i.e. so that tip channel 124 and main channel 120 are one and the same for the situation where fastener tips 18*a*, 18*b*, 18*c* are flush with front sleeve ends 74 or recessed within bore 76, and about 0.55 inch, more preferably between about 0.15 inch and about 0.275 inch, still more preferably about 0.235 inch. Because of the importance of the close clearance between fastener tips 18*a*, 18*b*, 18*c* and loading opening 40, it is important that the manufacturing tolerance of exposed tip length TL be tightly controlled because the smaller the manufacturing tolerance, the closer the clearance between fastener tip 18*a*, 18*b*, 18*c* and loading opening 40 is, the less likely that fastener tips 18*a*, 18*b*, 18*c* will dive back through loading opening 40.

4.2 Main Channel of Loading Opening

Continuing with FIG. 3, main channel 120 of loading opening 40 may have a generally rectangular shape so that sleeves 58 and fastener heads 16*a*, 16*b*, 16*c* fit through opening, however, preferably the shape of loading opening 40 is selected to correspond to the profile of collation 64*a*, 64*b*, 64*c* so that fasteners 12*a*, 12*b*, 12*c* and sleeves 58 sequentially fit through loading opening 40 only if they have the proper orientation. In one embodiment, main channel 120 of loading opening 40 is demarcated into a front channel 132 and a rear channel 134 by a pair of rails 130 that is axially spaced from shoulders 126, wherein rails 130 protrude into loading opening 40 for engaging the protrusions of sleeve 58, such as projections 82, 84, similar to how rails 86 in magazine 42 are engaged by projections 82, 84.

Rails 130 are aligned with rails 86 so that as magazine 42 feeds fasteners 12*a*, 12*b*, 12*c* and sleeves 58 to loading opening 40, collation 64*a*, 64*b*, 64*c* remains properly positioned with respect to loading opening 40 so that collation 64*a*, 64*b*, 64*c* is not hung up and so that fastener tips 18*a*, 18*b*, 18*c* are positioned properly with respect to tip channel 124 of loading opening 40. In addition to engaging projections 82, 84, rails 130 may also protrude laterally inwardly far enough so that they engage fastener shank 14*a*, 14*b*, 14*c* within a close clearance in order to further axially align fastener 12*a*, 12*b*, 12*c*.

As with shoulders 126 supporting front end 74 of second sleeve 58*b*, rails 130 support the second sleeve 58 by engaging and supporting projections 82, 84 so that the leading sleeve 58 is cleanly sheared as the leading fastener 12*a*, 12*b*, 12*c* is driven. Because rails 130 are engaged between projections 82, 84, they support the second sleeve 58 even when tool 10 is used in an inverted position.

Like rails 86 of magazine 42, preferably rails 130 have a thickness that is approximately equal to the distance between projections 82, 84, within a small clearance, so that the second sleeve 58 is prevented from skewing upwardly or downwardly. In one embodiment, wherein the distance between upper projections 82 and lower projections 84 is about 0.097 inch, the thickness of rails 130 is about 0.091 inch, so that there is an average clearance of about 0.003 inch on either side between rails 130 and projections 82, 84.

As shown in FIG. 3, main channel 120 of loading opening 40 may also include additional rails 136*a*, 136*b* that further demarcate main channel 120 into additional channels for receiving fastener head 16*a*, 16*b*, 16*c*. In one embodiment, main channel 120 further includes a pair of rails 136*a* spaced rearwardly from rails 130, there being a first head channel 137*a* rearwardly of rails 136*a* for accommodating the head 16*b* of medium fastener 12*b*, and a second head channel 137*b* spaced rearwardly from first head channel 137*a* by another pair of rails 136*b*, wherein second head channel 137*b* accommodates the head 16*c* of long fastener 12*c*. In one embodiment, upper collar 78 and head 16*a* of short fastener 12*a* is accommodated between rails 130 and rails 136*a*. Preferably, rails 136*a*, 136*b* only engage fastener shank 14*a*, 14*b*, 14*c*, and not fastener head 16*a*, 16*b*, 16*c*, to prevent hang-ups of collation 64*a*, 64*b*, 64*c* through loading opening 40. However, rails 136*a*, 136*b* may be positioned to support fastener heads 16*b*, 16*c* if desired.

As described above, preferably loading opening 40 is located though shear block 60. In one embodiment, shear block 60 has a thickness ST, so that shoulders 126, and rails 130, 136*a*, and 136*b* have a length through shear block 60 so that shoulders 126 and rails 130 support a substantial portion of second sleeve 58, and preferably all of second sleeve 58, still more preferably all of second sleeve 58 and a substantial portion of a third sleeve 58 (see FIGS. 6 and 7) so that the remainder of collation 64*a*, 64*b*, 64*c* that is not being driven is adequately supported so that when leading fastener 12*a*, 12*b*, 12*c* is driven, there is a clear break between leading sleeve 58 and second sleeve 58. Preferably, the side of loading opening 40 that faces into drive bore 38 is substantially aligned with breaking plane 98 between leading sleeve 58 and second sleeve 58 to further ensure a clean break. The thickness of shear block 60 also allows rails 130, 136*a*, and 136*b* to engage substantially all of shank 14*a*, 14*b*, 14*c* second fastener 12*a*, 12*b*, 12*c*, and preferably at least a portion of shank 14*a*, 14*b*, 14*c* of third fastener 12*a*, 12*b*, 12*c*. In one embodiment, shear block 60 has a predetermined thickness ST of between about ¼ inch and about ¾ inch, preferably between about ⅜ inch and about ⅝ inch, still more preferably about 0.59 inch, and shoulders 126 and rails 130, 136*a*, and 136*b* have a length that is substantially equal to the thickness ST of shear block 60.

5 Fastener Guide

Turning back to FIGS. 6 and 7, tool includes a telescoping fastener guide 44 for guiding fasteners 12*a*, 12*b*, 12*c* and sleeves 58 toward work piece 4 and substrate 2 as they are driven by driver blade 32. Fastener guide 44 receives the leading fastener 12*a*, 12*b*, 12*c* and sleeve 58 as they are driven from nosepiece 36 and shear block 60 and continues to guide leading fastener 12*a*, 12*b*, 12*c* and sleeve 58 toward work surface 6. Fastener guide 44 is coaxial with drive bore 38 so that as leading fastener 12*a*, 12*b*, 12*c* is driven axially forwardly, it will encounter and be guided by fastener guide 44. As described above, fasteners 12*a*, 12*b*, 12*c* are fed into drive bore 38 so that they are coaxially aligned with drive bore 38, so that fasteners 12*a*, 12*b*, 12*c* also are coaxially aligned with fastener guide 44.

In one embodiment, fastener guide 44 is generally cylindrical in shape with a generally cylindrical bore 138 extending through fastener guide 44 between a rear end 140 and a front end 144. Fastener guide bore 138 includes a portion 142 at rear end 140 of fastener guide 44 that is tapered toward axis 28 to guide a driven fastener 12*a*, 12*b*, 12*c* toward bore 138 in the event that fastener tip 18*a*, 18*b*, 18*c* becomes angled away from axis 28 of tool. Bore 138 may also include a tapered portion 146 at front end 144 in order to provide space for portions of sleeve 58 that split away from fastener 12*a*, 12*b*, 12*c* as fastener 12*a*, 12*b*, 12*c* is driven into work piece 4 and substrate 2.

Figure 6:
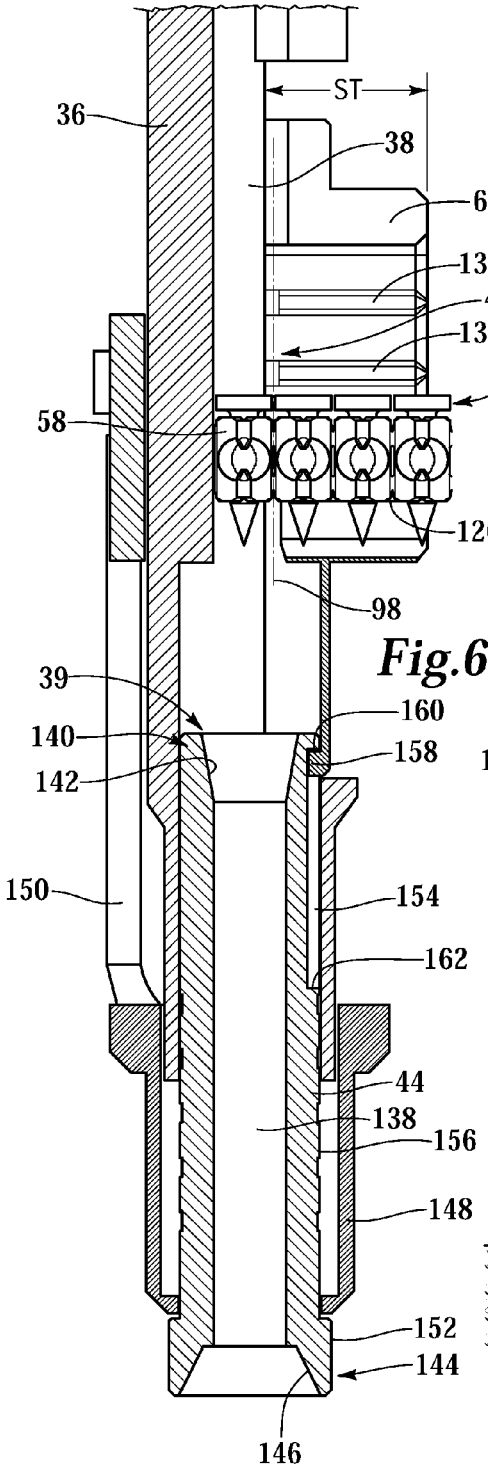
FIG. 6 is a close side sectional view of the nosepiece, a fastener guide and a shear block of the fastener driving tool, wherein the nosepiece is in the extended position.
Figure 7:
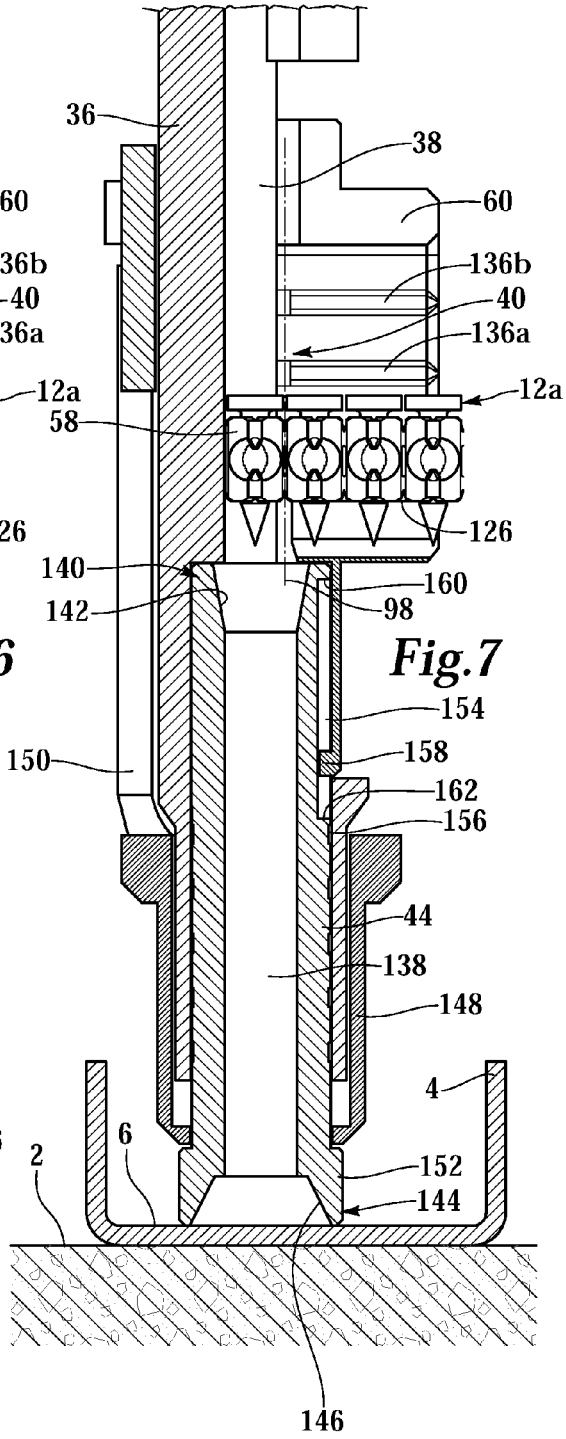
FIG. 7 is a close side sectional view of the nosepiece, the fastener guide, and the shear block, wherein the nosepiece is in the retracted position.

Fastener guide 44 is movable between an extended position, shown in FIG. 6, and a retracted position, shown in FIG. 7, relative to nosepiece 36, shear block 60, and tool body 20, wherein fastener guide 44 is moved from the extended position to the retracted position when fastener guide 44 is abutted against work piece 4. When tool 10 is fired, a reactionary force is created in tool body 20 that causes tool body 20 to recoil away from work piece 4 and substrate 2. Nosepiece 36, shear block 60, and magazine 42 are operatively connected to tool body 20, so that when tool body recoils, so does nosepiece 36, shear block 60, and magazine 42. If fastener guide 44 were also to recoil along with nosepiece 36 and shear block 60, then nosepiece will lift off work piece 4 so that when fastener 12*a*, 12*b*, 12*c* exited fastener guide 44, it may be in free flight before it entered work piece 4 and substrate 2, which may cause fastener 12*a*, 12*b*, 12*c* to be driven at an undesired position, or misalignment of fastener 12*a*, 12*b*, 12*c* with respect to work piece 4, so that fastener may break, shear, or ricochet rather than drive cleanly through work piece 4 and substrate 2.

For this reason, fastener guide 44 is configured so that it remains in abutment with work piece 4 when tool body 20 and nosepiece 36 recoil due to firing of tool 10. Fastener guide 44 is free to move independent of nosepiece 36 and shear block between the extended position and the retracted position, so that as nosepiece 36 recoils, fastener guide 44 is moved from the retracted position to the extended position. A spring (not shown) may also be included to bias fastener guide 44 toward the extended position to ensure that fastener guide 44 does not recoil as tool body recoils, but rather remains abutted against work piece 4.

Because fastener guide 44 is separate from nosepiece 36 and shear block 60, and because fastener guide 44 moves independently of nosepiece 36 and shear block 60 as fastener guide 44 moves from the extended position to the retracted position, tool 10 has a loading opening 40 that is stationary with respect to magazine 42 so that there is a fixed loading position of fasteners 12*a*, 12*b*, 12*c* with respect to subsequent collations 64*a*, 64*b*, 64*c*. A fixed loading position with respect to magazine 42 allows a user to push fastener guide 44 against work surface 6 multiple times before firing without moving the leading fastener 12*a*, 12*b*, 12*c* and sleeve 58 up or down within drive bore 38, so that there is reduced risk of the second fastener 12*a*, 12*b*, 12*c* being loaded into drive bore 38 before the leading fastener 12*a*, 12*b*, 12*c* is driven.

Continuing with FIGS. 1, 2, 6 and 7, fastener guide 44 is operatively connected to the power source so that the power source is activated when fastener guide 44 is placed in abutment with work surface 6 and moved into the retracted position. In one embodiment, fastener guide 44 is operatively connected to combustion chamber sleeve 50 via an actuator 148 and a link 150 so that when fastener guide 44 is in the extended position with respect to nosepiece 36, combustion chamber sleeve 50 is in the open position, and when fastener guide 44 is pushed against work surface 6 and moved into the retracted position, combustion chamber sleeve 50 is pushed into the closed position, so that combustion chamber 34 is activated when fastener guide 44 is pushed against work surface 6. As tool body 20 recoils due to the firing of tool 10, combustion chamber sleeve 50 remains operatively connected to fastener guide 44 so that combustion chamber sleeve 50 is moved from the closed position into the open position so that tool 10 will not be able to be fired again until fastener guide 44 is pushed into the retracted position again.

Continuing with FIGS. 6 and 7, fastener guide 44 is preferably generally cylindrical in shape so that fastener guide 44 may be mounted with nosepiece 36 and shear block 60. In one embodiment, fastener guide 44 is mounted radially within a forward end 39 of drive bore 38, with forward end 144 of fastener guide 44 extending out of drive bore 38. In one embodiment, fastener guide 44 is also mounted within a generally cylindrical actuator 148, wherein forward end 144 of fastener guide 44 extends out of actuator 148 as well. Fastener guide 44 includes a radially outwardly protruding flange 152 that engages actuator 148 when fastener guide 44 is pushed into the retracted position so that flange 152 pushes actuator 148 rearwardly with respect to tool body 20. Actuator 148, in turn, is connected to a link 150, which is operatively connected to combustion chamber sleeve 50, so that as actuator 148 is pushed rearwardly by fastener guide 44, it pushes link 150 rearwardly, which pushes combustion chamber sleeve 50 rearwardly into the closed position, activating combustion chamber 34 allowing tool 10 to be fired.

Fastener guide 44 may be slidably mounted to nosepiece 36 or shear block 60 so that fastener guide 44 does not fall out of engagement with tool 10. In one embodiment, fastener guide 44 includes an axially extending groove 154 that extends for a predetermined distance along the outside surface 156 of fastener guide 44, wherein groove 154 accepts a key 158 of shear block 60 that is inserted into groove 154 when shear block 60 is mounted to nosepiece 36. When fastener guide 44 is in the extended position, key 158 is positioned so that it engages rear end 160 of groove 154, as shown in FIG. 6. When fastener guide 44 is moved to the retracted position, key 158 slides along groove 154 until key 158 is positioned at a front end 162 of groove 154 so that key engages front end 162, as shown in FIG. 7.

6 Collation and Tool System

A system for fastening a work piece 4 to a substrate 2 is provided, wherein the system includes a first collation 64*a* having a plurality of sleeves 58 holding fasteners 12*a* each having a predetermined exposed tip length TL, a second collation 64*b* having a plurality of sleeves 58 holding fasteners 12*b* each having substantially the same predetermined exposed tip length TL, wherein fasteners 12*b* are of different length FL than fasteners 12*a*. Fastener driving tool 10 includes a tool body 20 having a forward end 22, a rear end 24, and a cylinder 26 with an axis 28. A piston 30 is mounted within cylinder 26, and a power source, such as combustion chamber 34 for combusting fuel, is provided to drive piston 30 axially forwardly. A driver blade 32 extends axially forwardly from piston 30, and a nosepiece 36 extends axially forwardly from forward end 22 of tool body 20. Nosepiece 36 encloses a drive bore 38 for guiding fasteners 12*a* and driver blade 32 forwardly, wherein there is a loading opening 40 into drive bore 38, wherein loading opening 40 has a main channel 120 and a tip channel 124 having a depth TCD that is slightly larger than the exposed tip length TL so that there is a small clearance though which the tips 18*a* can pass.

The system my further include a third collation 64*c* with sleeves 58 holding fasteners 12*c*, wherein fasteners 12*b* also have tips 18*b* with substantially the same predetermined exposed tip length TL as collations 64*a* and 64*c* so that the clearance of tip channel 124 is large enough for tips 18*b* also. Fasteners 12*c* of third collation 64*c* are of different length than fasteners 12*a* and 12*b*

A system of collations 64*a*, 64*b*, 64*c* having fasteners 12*a*, 12*b*, 12*c* of different lengths FL, but with substantially the same exposed tip length TL, along with tool 10 having loading opening 40 with tip channel 124 having a depth that is slightly larger than the predetermined exposed tip length TL, allows a user of the system to have the tool and fasteners that are needed for various applications that are readily available. For example, a user may need short fasteners 12*a* (FIG. 8A) for attaching thin metal tracks 4 to hard substrates 2, such as concrete or steel, and longer fasteners, e.g., medium fasteners 12*b* (FIG. 8B), for attaching plywood work pieces to concrete or steel substrates, then the system of collations 64*a* of short fasteners 12*a*, collations 64*b* of medium fasteners 12*b*, and fastener driving tool 10 may be provided to the user, and the user may simply select the appropriate collation 64*a*, 64*b* having the appropriate length FL fastener 12*a*, 12*b* for whichever application the user is currently working on. The system may include collations 64*c* of long fasteners 12*c* (see FIG. 8C), which may be used by the user for thicker work pieces, or additional holding strength.

7 Method of Selecting and Driving Fastener

A method of selecting and driving a fastener 12*a*, 12*b*, 12*c* for a particular application is provided comprising the steps of providing a first collation 64*a* of a plurality of sleeves 58 holding first fasteners, such as short fasteners 12*a* each having a tip 18*a* with a predetermined exposed tip length TL below front sleeve end 74, providing a second collation 64*c* of a plurality of sleeves 58 each holding a corresponding second fastener, such as long fasteners 12*c* each having a tip 18*c* with substantially the same predetermined exposed tip length TL below front end 74, wherein fasteners 12*c* are longer than fasteners 12*a*, wherein short fasteners 12*a* and long fasteners 12*c* are adapted to be serially and individually driven through drive bore 38 of fastener driving tool 10 by a drive member, such as driver blade 32, so as to be discharged from tool 10, there being a loading opening 40 into drive bore 38 having a main channel 120 and a tip channel 124 providing a small clearance through which tips 18*a* or tips 18*c* can pass, the main channel 120 of loading opening 40 being long enough to accommodate short fasteners 12*a* and long fasteners 12*c*, selecting one of first collation 64*a* or second collation 64*c* for the desired length FL of fastener 12*a*, 12*c* for a particular application (i.e. short fastener 12*a* for a thin work piece 4, long fastener 12*c* for a thick plywood work piece), feeding the fasteners 12*a*, 12*c* of the selected collation 64*a*, 64*c* through loading opening 40, and driving the fasteners 12*a*, 12*c* of the selected collation 64*a*, 64*c* with driver blade 32.

The method also may include the step of providing a third collation 64*b* of a plurality of sleeves 58 each holding a third fastener, such as medium fastener 12*b* having a tip 18*b* with substantially the same predetermined exposed tip length TL below front end 74, wherein fastener 12*b* is longer than short fasteners 12*a*, but shorter than long fasteners 12*c*. This method also includes the step of selecting any one of the first collation 64*a* of short fasteners 12*a*, the second collation 64*b* of medium fasteners 12*b*, or the third collation 64*c* of long fasteners 12*c*, and feeding the fasteners 12*a*, 12*b*, 12*c* of the selected collation 64*a*, 64*b*, 64*c* to drive bore 38.

In one aspect, the method includes a step of determining which of the short fasteners 12*a*, medium fasteners 12*b*, or long fasteners 12*c* should be used for a particular application. This determining step may be determined by experimentation, experience, or professional judgment on the part of the user of tool 10. For example, it has been learned through previous testing that long fastener 12*c* having a fastener length FL of about 1 inch may not be ideal for fastening a thin metal work piece 4, like metal tracking, to a hard substrate 2, such as concrete or steel, as described above, so that short fastener 12*a* having a length FL of about ½ inch may be preferred. In contrast, short fastener 12*a* may not be long enough to extend through a thicker work piece, such as a ¾ inch thick plywood substrate, so that long fastener 12*c* may be preferred for the latter application.

In summary, a fastener driving tool according to the present invention allows a user to drive fasteners of various lengths while reducing the risk of shorter fasteners diving back into the magazine and jamming or damaging the tool, while improving guidance of longer fasteners. The tool may provide a telescoping nosepiece that remains abutted against the work surface when the rest of the tool recoils due to the firing of the tool while providing a fixed loading position. Collations according to the present invention allow fasteners of various lengths to be driven by a fastener driving tool while reducing the risk of shorter fasteners diving back into the magazine and jamming or damaging the tool.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A collation for transporting fasteners along rails disposed within a magazine of a fastener driving tool, comprising:

a plurality of sleeves for supporting and carrying a plurality of fasteners through said magazine, each of said plurality of sleeves having a front and a rear with a predetermined length therebetween of between about ¼ and about 0.4 inch and rail engaging means, each of said plurality of fasteners having a predetermined fastener length of between about ¾ inch and about 2 inches and a tip located at a predetermined position from behind said front to about ¼ inch beyond said front in order to reduce dive-back into said magazine and improve guidance of said plurality of fasteners; each fastener having an exposed neck having a length that is between about ¼ inch and about 1½ inch;

said plurality of sleeves being connected together in a serial array permitting the separation of a leading one of said plurality of sleeves from remaining ones of said plurality of serially arranged sleeves when a drive member of said fastener driving tool drives a leading one of the plurality of fasteners disposed within said leading one of said plurality of sleeves;

wherein said sleeves are substantially symmetrical about a plane bisecting said predetermined length.

2. A collation according to claim 1, wherein each tip protrudes beyond said front of said sleeve so that each fastener has a predetermined exposed tip length, wherein each fastener includes an exposed neck having a length that is at least about as long as said predetermined exposed tip length.

3. A collation according to claim 1, wherein each tip protrudes beyond said front of said sleeve so that each fastener has a predetermined exposed tip length, wherein each fastener includes an exposed neck having a length that is at least approximately twice said predetermined exposed tip length.

4. A collation according to claim 1, wherein said fastener length is about ¾ inch; wherein said sleeve length is about 0.32 inch, and wherein each sleeve includes a rear end and each fastener has a head spaced from said rear end by about 0.22 inch.

5. A collation according to claim 1, wherein said fastener length is about 1 inch.

6. A collation according to claim 1, wherein said predetermined position of said tip is from about 0.05 inch behind said front to about ¼ inch beyond said front.

7. A collation according to claim 1, wherein said sleeve length is about 0.32 inch.

8. A collation according to claim 1, wherein said tip is located between about 0.2 inch and ¼ inch beyond said front.

9. A collation according to claim 1, and further including a plurality of frangible bridges integrally connecting said plurality of sleeves together in a serial array and facilitating said separation of a leading one of said plurality of sleeves from remaining ones of said plurality of serially arranged sleeves when a drive member of said fastener driving tool drives a leading one of the plurality of fasteners disposed within said leading one of said plurality of sleeves.

10. A collation for transporting fasteners along rails disposed within a magazine of a fastener driving tool, comprising:

a plurality of sleeves for supporting and carrying a plurality of fasteners through said magazine, each of said plurality of sleeves having a front and a rear with a predetermined length therebetween of between about ¼ and about 0.4 inch, each of said plurality of fasteners having a predetermined fastener length of between about ¾ inch and about 1½ inch and a tip located at a predetermined position from behind said front to about ¼ inch beyond said front;

said plurality of sleeves being connected together in a serial array permitting the separation of a leading one of said plurality of sleeves from remaining ones of said plurality of serially arranged sleeves when a drive member of said fastener driving tool drives a leading one of the plurality of fasteners disposed within said leading one of said plurality of sleeves, and a plurality of protrusions which include contact tip regions for engaging surface portions of said rails;

wherein said sleeves are substantially symmetrical about a plane bisecting said predetermined length.

11. A collation according to claim 10, wherein said protrusions include a first protrusion extending downward and a second protrusion extending upward, said first and second protrusion being generally vertically aligned.

12. A collation according to claim 10, wherein said predetermined position of said tip is from about 0.05 inch behind said front to about ¼ inch beyond said front.

13. A collation according to claim 10, wherein said tip is located between about 0.2 inch and ¼ inch beyond said front.

14. A collation according to claim 10, wherein said sleeve length is about 0.32 inch.

15. A collation according to claim 10, said sleeves each including a bore with a substantially square cross-section.

16. A collation for transporting fasteners along rails disposed within a magazine of a fastener driving tool, comprising:

a plurality of sleeves for supporting and carrying said plurality of fasteners through said magazine, each of said plurality of sleeves having a front and a rear with a predetermined length therebetween of about 0.32 inch, each of said plurality of fasteners having a predetermined fastener length of about ½ inch and a tip located at a predetermined position from behind said front to about ¼ inch beyond said front; and wherein each fastener has a head spaced from said rear by between about 0.001 inch and about 0.02 inch;

said plurality of sleeves being connected together in a serial array permitting the separation of a leading one of said plurality of sleeves from remaining ones of said plurality of serially arranged sleeves when a drive member of said fastener driving tool drives a leading one of the plurality of fasteners disposed within said leading one of said plurality of sleeve;

wherein said sleeves are substantially symmetrical about a plane bisecting said predetermined length.

17. A collation according to claim 16, wherein said tip is located between about 0.2 inch and ¼ inch beyond said front.

18. A collation according to claim 16, wherein a sleeve is substantially symmetrical about a plane bisecting a width of said sleeve and about a plane bisecting a depth of said sleeve.

19. A collation according to claim 16, wherein said front and said rear of said sleeves each include at least one V-shaped notch.

20. A collation according to claim 16, wherein said sleeves include a plurality of protrusions for engaging surface portions of said rails, said plurality of protrusions including a first protrusion extending downward and a second protrusion extending upward, said first and second protrusion being generally vertically aligned.

* * * * *